US006159670A

United States Patent [19]

Buongiorne et al.

[11] Patent Number: 6,159,670

[45] Date of Patent: Dec. 12, 2000

[54] CALCIUM ION STABLE PHOTOGRAPHIC COLOR DEVELOPING CONCENTRATE AND METHOD OF MANUFACTURE

[75] Inventors: Jean M. Buongiorne, Brockport; Michael J. Haight, Rochester, both of N.Y.

[73] Assignee: Eastman Kodak Company, Rochester, N.Y.

[21] Appl. No.: 09/437,513

[22] Filed: Nov. 10, 1999

[51] Int. Cl.[7] ..... G03C 7/413

[52] U.S. Cl. ..... 430/491; 430/490; 430/492; 430/493

[58] Field of Search ..... 430/493, 492, 430/491, 490

[56] References Cited

U.S. PATENT DOCUMENTS

| | | | |
|---|---|---|---|
| 4,546,068 | 10/1985 | Kuse | 430/375 |
| 4,596,765 | 6/1986 | Kurematsu et al. | 430/467 |
| 4,876,174 | 10/1989 | Ishikawa et al. | 430/380 |
| 4,892,804 | 1/1990 | Vincent et al. | 430/380 |
| 4,900,651 | 2/1990 | Ishikawa et al. | 430/380 |
| 4,975,357 | 12/1990 | Buongiorne et al. | 430/434 |
| 5,034,308 | 7/1991 | Abe et al. | 430/372 |
| 5,273,865 | 12/1993 | Loiacono et al. | 430/490 |
| 5,354,646 | 10/1994 | Kobayashi et al. | 430/372 |
| 5,660,974 | 8/1997 | Marrese et al. | 430/490 |
| 6,017,687 | 1/2000 | Darmon et al. | 430/493 |

FOREIGN PATENT DOCUMENTS

| | | |
|---|---|---|
| 0 204 372 | 10/1986 | European Pat. Off. . |
| 0 793 141 A2 | 9/1997 | European Pat. Off. . |
| 0 800 111 A1 | 10/1997 | European Pat. Off. . |

OTHER PUBLICATIONS

*Research Disclosure*, publication 13410, Jun., 1975.
*Research Disclosure*, publication 20405, Apr., 1981.
*Research Disclosure*, publication 18837, Dec., 1979.

*Primary Examiner*—Hoa Van Le
*Attorney, Agent, or Firm*—J. Lanny Tucker

[57] ABSTRACT

A homogeneous, ready to use, single-part color developing concentrate comprises a color developing agent in free base form, an antioxidant for the color developing agent, a buffering agent, and a water-miscible or water-soluble hydroxy-substituted, straight-chain organic solvent present in an a concentration such that the weight ratio of water to the organic solvent is from about 15:85 to about 50:50. In addition the concentrate includes a mixture of a specific polyaminopolyphosphonic acid and either a hydroxyalkylidenediphosphonic acid or morpholinomethanediphosphonic acid (or salt thereof) for stability in the presence of calcium ions. This concentrate is prepared by mixing the components in a unique order for improved safety and manufacturability. It can be used to make a working strength processing solution, or it can be used as a replenishing composition with proper dilution to provide color images in photographic silver halide materials.

24 Claims, No Drawings

CALCIUM ION STABLE PHOTOGRAPHIC COLOR DEVELOPING CONCENTRATE AND METHOD OF MANUFACTURE

COPENDING APPLICATION

Copending and commonly assigned U.S. Ser. No. 09/438,121, filed on even date herewith by Haye et al and entitled "Calcium Ion Stable Photographic Color Developing Composition and Method of Use".

FIELD OF THE INVENTION

The present invention relates to single-part, ready to use, homogeneous photographic color developing concentrates that are stable to calcium ions, and to a method for their manufacture. This invention is useful in the field of photography to provide color photographic images.

BACKGROUND OF THE INVENTION

The basic processes for obtaining useful color images from exposed color photographic silver halide materials include several steps of photochemical processing such as color development, silver bleaching, silver halide fixing and water washing or dye image stabilizing using appropriate photochemical compositions.

Photographic color developing compositions are used to process color photographic materials such as color photographic films and papers to provide the desired dye images early in the photoprocessing method. Such compositions generally contain color developing agents, for example 4-amino-3-methyl-N-(2-methane sulfonamidoethyl)aniline, as reducing agents to react with suitable color forming couplers to form the desired dyes. U.S. Pat. No. 4,892,804 (Vincent et al) describes conventional color developing compositions that have found considerable commercial success in the photographic industry. Other known color developing compositions are described in U.S. Pat. No. 4,876,174 (Ishikawa et al), U.S. Pat. No. 5,354,646 (Kobayashi et al) and U.S. Pat. No. 5,660,974 (Marrese et al).

It is common practice to add a "replenishing" solution to the color developing composition in the processing machine in order to replace photochemicals that are depleted during reaction or carried away by the processed materials. Such replenishment insures uniform development and maximum stability of the color developing agent.

Color developing compositions are commonly supplied in three or more "parts" (or solutions) that are mixed immediately before use. Multiple parts are often required in order to separate and preserve the chemical activity and solubility of components that may otherwise deteriorate or react with each other when they are stored together for long periods of time under alkaline conditions. For example, one part might include a color developing agent. Another part might contain agents to preserve the alkalinity of the mixed color developing composition. Still another part may include an optical brightener. Upon combination of all parts and water, a homogeneous color developing composition can usually be obtained for the working strength solution in the processing machine.

There is a desire in the industry to reduce the number of parts used to prepare color developing compositions, and particularly to prepare replenishing solutions. A wide range of compositions are described in the art or commercially available as "ready to use" solutions, concentrates or dry formulations. Liquid concentrates have only to be diluted with water to provide a working strength solution. Dry formulations need only be dissolved in water. For example, EP-A-0 793,141 (Chugai Photo) describes a two-part color developing composition that can be supplied in either solid or liquid form.

It is generally known that the concentrations of various photochemicals used in a photographic processing bath must lie within certain narrow limits in order to provide optimal performance. The most important solvent for such photoprocessing is water. Most inorganic salts can be readily dissolved in water while the organic photochemicals in such processing baths usually have suitable solubility in water at the desired operating concentrations.

However, water is both an asset and a major problem of ready-to-use and some concentrated photographic compositions because of its presence in high quantity. As a result, the costs of manufacturing, transport and storage of such compositions is steadily growing. Normally, the user of photochemical compositions has water available in which individual photochemicals could be mixed or diluted, but this is usually not practical for a number of reasons. The exact composition of the photochemicals is not readily determined by a common user and manufacturers are not likely to readily provide their formulations for such a purpose. Moreover, even if the formulations are known, mixing mistakes may result in poor photoprocessing results.

For these reasons, there is a trend in the photographic industry to provide photoprocessing compositions (including color developing compositions) in concentrated form so that the manufacturer and user need not pay for use, transport or storage of large volumes of water, and to enable use of smaller containers. Moreover, there has been a desire in the industry to provide compositions that can be used right out of their containers without the need for mixing various components (thereby reducing mixing errors), such as in what are known as "automatic replenishing" processors.

The industry has investigated the use of both concentrates and solid mixtures (including powders and tablets). In most cases, concentrates are convenient to use but may have high packaging costs compared to powders. Powders permit high concentration, but not every photochemical composition can be dried into a stable powder. In addition, powders present problems with dust, separate packaging needs and more troublesome metering or mixing procedures. Not all dry formulations are readily dissolved in water.

Another concentrated form known in the art is a chemical paste or slurry, as described for example in EP-A-0 204,372 (Chemco) and EP-A-0 800,111 (Fuji Photo). These formulations have still other disadvantages, namely lack of homogeneity and slow dissolution rate of solid components.

Additional small volume, ready to use color developing compositions are described in U.S. Pat. No. 5,273,865 (Loiacono et al). These compositions are said to be free of bromides, hydroxylamines and benzyl alcohol, to include a polyol compound having 4 to 8 hydroxy groups, and to be useful for rapid access processing of photographic elements having high silver bromide emulsions only.

The casual observer might consider that all of the conventional "parts" used to provide color developing compositions might be readily combined to form a single-part homogeneous composition. This is not as easy as one may think. Interactions among and deterioration of photochemicals are magnified in concentrated form, and the resulting action on processed photographic materials may be undesirable because of the resulting poor images.

Some color developing compositions are commercially available in single-part formulation that overcome some of the noted problems, but because of the presence of precipitates (such as in slurries) or multiple solvent phases, they require vigorous agitation or mixing before use. Such compositions are generally limited to small volumes. In addition, the presence of the precipitates or "sludge" is unattractive to users. Some users may not have suitable equipment for proper agitation of multi-phase compositions to keep them uniform in composition.

There was a need in the photographic industry for a single-part color developing composition that is homogeneous, concentrated and stable. Such an attractive photographic product is described and claimed in U.S. Ser. No. 09/132,200 filed Aug. 11, 1998 by Darmon et al. This product has found ready acceptance in the marketplace and includes a metal ion sequestering agent similar to those described in *Research Disclosure* publication 13410 (June 1975) and publication 20405 (April 1981). These metal ion sequestering agents are said to stabilize color developing compositions in the presence of heavy metal ions such as iron and copper ions. *Research Disclosure* is a publication of Kenneth Mason Publications Ltd., Dudley House, 12 North Street, Emsworth, Hampshire PO10 7DQ England (also available from Emsworth Design Inc., 121 West 19th Street, New York, N.Y. 10011).

However, it has been found that some color developing compositions, whether prepared from concentrates or not, are formulated using local water supplies that are high in calcium ion content. It is necessary to insure that color developing compositions, particularly in concentrated form, are not adversely affected by the inordinate calcium ion content that may be evident in some locales. Thus, it is desired to insure that such compositions are stable from precipitates, especially calcium precipitates that may evident as scale or deposits on processing equipment. In addition, it is critical to find a way to make such compositions as concentrates in a safe and economical manner while providing a product that is homogeneous, precipitate-free and clear in appearance.

SUMMARY OF THE INVENTION

This invention provides an advance in the art with a homogeneous, ready to use, single-part color developing concentrate having a pH of from about 7 to about 13, and comprising:

a) at least 0.01 mol/l of a color developing agent in free base form, b) at least 0.005 mol/l of an antioxidant for the color developing agent, c) water, d) a photographically inactive water-miscible or water-soluble hydroxy-containing, straight-chain organic solvent for the color developing agent in free base form, the organic solvent having a molecular weight of from about 50 to about 200 and being present in the concentrate at a concentration such that the weight ratio of water to the solvent is from about 15:85 to about 50:50, e) at least 0.005 mol/l of a polyaminopolyphosphonic acid or a salt thereof having at least five phosphonic acid groups, or a salt thereof, f) at least 0.0001 mol/l of a diphosphonic acid that is either: a hydroxyalkldenediphosphonic acid or a salt thereof, or morpholinomethanediphosphonic acid or a salt thereof, and g) a buffering agent that is miscible in the organic solvent.

Further, this invention includes a method for providing a color image in a color silver halide photographic element comprising contacting the element with, upon dilution of at least four times, the single-part color developing concentrate described above. This color developing step in a photographic processing method can be followed by desilvering the color photographic silver halide element, as well as any other useful photoprocessing steps known in the art.

This invention also provides a photographic processing chemical kit comprising:

a) the homogeneous, ready to use, single-part color developing concentrate described above, and b) one or more of the following compositions:

a photographic bleaching composition, a photographic bleach/fixing composition, a photographic fixing composition, and a photographic stabilizing or final rinsing composition.

Still again, a method of preparing a homogeneous, ready to use, sulfate-free, single-part color developing final concentrate comprises the steps of:

A) mixing in water, a color developing agent present as a sulfate salt, an antioxidant for the color developing agent, alkali metal ions in at least stoichiometric proportion to the sulfate ions, and a photographically inactive, water-miscible or water-soluble, hydroxy-containing, straight-chain organic solvent, the organic solvent having a molecular weight of from about 50 to about 200 and being present in the final concentrate at a weight ratio of water to the solvent of from about 15:85 to about 50:50, to form a water-insoluble alkali metal sulfate in a first solution, B) removing the water-insoluble alkali metal sulfate from the first solution, C) forming a second solution in water comprising a buffering agent that is soluble in the organic solvent, and a polyaminopolyphosphonic acid that has at least five phosphonic acid groups in an amount to provide at least 0.005 mol/l in the final concentrate, D) prior to step C, adding to the first or second solution a diphosphonic acid that is either a hydroxyalkylidene diphosphonic acid (or a salt thereof) or morpholinomethanediphosphonic acid (or a salt thereof), the diphosphonic acid being present in the final concentrate at a concentration of at least 0.0001 mol/l, provided that the diphosphonic acid is diluted in water so that the pH is 6 or more prior to its addition to the first or second solution, and E) mixing the first and second solutions to form the final concentrate.

The single-part color developing concentrate of this invention offers a number of advantages over the photochemical compositions currently available or known. The concentrate has minimal water, resulting in considerable savings in manufacturing, shipping and storage costs. In addition, it is a homogeneous composition, meaning that it is free of precipitates, slurries or multiple solvent phases. It does not require vigorous agitation prior to use, and can be immediately and readily metered into a photographic processing tank or bath with minimal instruction or possibility of mistake. For example, the concentrate can be used in "automatic replenishing" processors where the processing composition is diluted and used as needed. Importantly, it provides a single-part composition so the mixing of multiple parts, whether liquid or solid, is avoided.

Moreover, formulating the photochemicals needed for color development into a single-part composition resulted in no loss in chemical stability of any of those chemicals (such as the antioxidant and color developing agent) or composition pH. This was unexpected because it is well known in the art that several of such photochemicals adversely affect each other, and because of that, they were usually separated in multiple parts for shipping and storage. We formulated the components in a particular order to achieve improved manufacturability and safety and to insure desired pH, buffering capacity and photochemical activity of the concentrate.

The homogeneity noted above has been achieved by removing the sulfate ion with a mixing sequence that is an advance in the art, as described in copending U.S. Ser. No. 09/132,200 (noted above). Thus, sulfate ions are removed during a first step of the formulation procedure, providing a substantially clear solution that is ready to use for making up a working strength solution, or as a replenisher as described in copending and commonly assigned U.S. Ser. No. 09/438,121 filed on even date hereby by Haye et al (noted above).

Thus, the sulfate ions are removed early in the formulation of the composition by precipitating them in the presence of an alkali metal base and a particular water-soluble or water-miscible hydroxy-containing, straight chain organic solvent. This solvent has a critical molecular weight of from about 50 to about 200 for effectiveness and solubility. The sulfate precipitate is readily removed before additional photochemicals are added to the solution. Preferably, the resulting color developing concentrate is essentially sulfate ion free (meaning less than 0.005 mol/l of sulfate ion).

In addition, the color developing concentrate of this invention offers a number of advantages over the photochemical color developing compositions currently available or known in the art. It is not susceptible to calcium ion and other precipitates because of the presence of a combination of specific amounts of two specific types of polyphosphonic acids (or salts thereof). Each specific type of polyphosphonic acid alone fails to provide this advantage, and other combinations of known heavy metal ion sequestering agents also fail in this regard. Thus, only the specific combination of materials described herein provides the protection against the variable calcium ion concentration throughout the world. The concentrate of the invention is stable upon storage and use irrespective of the source of make-up water.

DETAILED DESCRIPTION OF THE INVENTION

In a preferred embodiment of this invention, a homogeneous, ready to use, single-part color developing concentrate is prepared using a critical sequence of steps:

In the first step, a first solution (typically an aqueous solution) of a suitable color developing agent is prepared. This color developing agent is generally in the form of a sulfate salt. Other components of the solution can include an antioxidant for the color developing agent, a suitable number of alkali metal ions (in an at least stoichiometric proportion to the sulfate ions) provided by an alkali metal base, and a photographically inactive water-miscible or water-soluble hydroxy-containing organic solvent. This solvent is present in the final concentrate at a concentration such that the weight ratio of water to the organic solvent is from about 15:85 to about 50:50.

In this environment, especially at high alkalinity, alkali metal ions and sulfate ions form a water-insoluble sulfate salt that is precipitated in the presence of the hydroxy-containing organic solvent. The precipitated sulfate salt can then be readily removed using any suitable liquid/solid phase separation technique (including filtration, centrifugation or decantation) to provide a "first" solution. If the antioxidant is a liquid organic compound, two phases may be formed and the precipitate may be removed by discarding the aqueous phase.

Subsequently, a "second" solution is formed by mixing in water one or more buffering agents (described below) that are soluble in the noted organic solvent, and one or more polyaminopolyphosphonic acids (described below also) in an amount sufficient to provide at least 0.005 mol/l in the final concentrate that is formed by this invention. This second solution can also include other components if desired, including, but not limited to, the optical brighteners, halides, organic solvents, alkanolamines and other additives described herein.

Prior to the formation of the second solution, one or more diphosphonic acids (described below) are diluted in water so that the resulting solution of diphosphonic acid(s) has a pH of at least 6, and preferably at least 8. This diluted diphosphonic acid(s) can then be added to either the first or second solution in an appropriate manner. Preferably, the second solution is formed by adding the diluted diphosphonic acid to an aqueous solution of the buffering agent and polyaminopolyphosphonic acid.

Finally, the first and second solutions are mixed in a suitable manner to provide the desired final homogeneous, ready to use single part concentrate. The mix order of these two solutions is irrelevant.

Alternatively, if the diphosphonic acid is used in the form of an alkali metal or ammonium salt, it may be added to the second solution at any time. In addition, such salts could be added at the end of preparing the first solution.

In still another embodiment, the diphosphonic acid can be added at the end of the preparation of the first solution.

Thus, the color developing concentrates of this invention include one or more color developing agents that are well known in the art that, in oxidized form, will react with dye forming color couplers in the processed materials. Such color developing agents include, but are not limited to, aminophenols, p-phenylenediamines (especially N,N-dialkyl-p-phenylenediamines) and others which are well known in the art, such as EP 0 434 097A1 (published Jun. 26, 1991) and EP 0 530 921A1 (published Mar. 10, 1993). It may be useful for the color developing agents to have one or more water-solubilizing groups as are known in the art. Further details of such materials are provided in Research Disclosure, publication 38957, pages 592–639 (September 1996).

Preferred color developing agents include, but are not limited to, N,N-diethyl p-phenylenediamine sulfate (KODAK Color Developing Agent CD-2), 4-amino-3-methyl-N-(2-methane sulfonamidoethyl)aniline sulfate, 4-(N-ethyl-N-β-hydroxyethylamino)-2-methylaniline sulfate (KODAK Color Developing Agent CD-4), p-hydroxyethylethylaminoaniline sulfate, 4-(N-ethyl-N-2-methanesulfonylaminoethyl)-2-methylphenylenediamine sesquisulfate (KODAK Color Developing Agent CD-3), 4-(N-ethyl-N-2-methanesulfonylaminoethyl)-2-methylphenylenediamine sesquisulfate, and others readily apparent to one skilled in the art.

In order to protect the color developing agents from oxidation, one or more antioxidants are generally included in the color developing compositions. Either inorganic or organic antioxidants can be used. Many classes of useful antioxidants are known, including but not limited to, sulfites (such as sodium sulfite, potassium sulfite, sodium bisulfite and potassium metabisulfite), hydroxylamine (and derivatives thereof), hydrazines, hydrazides, amino acids, ascorbic acid (and derivatives thereof), hydroxamic acids, aminoketones, mono- and polysaccharides, mono- and polyamines, quaternary ammonium salts, nitroxy radicals, alcohols, and oximes. Also useful as antioxidants are 1,4-cyclohexadiones as described in copending and commonly assigned U.S. Ser. No. 09/123,976 (filed Jul. 29, 1998 by Qiao and McGarry). Mixtures of compounds from the same or different classes of antioxidants can also be used if desired.

Especially useful antioxidants are hydroxylamine derivatives as described for example, in U.S. Pat. No. 4,892,804 (Vincent et al), U.S. Pat. No. 4,876,174 (Ishikawa et al), U.S. Pat. No. 5,354,646 (Kobayashi et al) and U.S. Pat. No. 5,660,974 (Marrese et al), and U.S. Pat. No. 5,646,327 (Burns et al), the disclosures of which are all incorporated herein by reference with respect to antioxidants. Many of these antioxidants are mono- and dialkylhydroxylamines having one or more substituents on one or both alkyl groups. Particularly useful alkyl substituents include sulfo, carboxy, amino, sulfonamido, carbonamido, hydroxy and other solubilizing substituents. One useful hydroxylamine antioxidant is N,N-diethylhydroxylamine.

In other embodiments, the noted hydroxylamine derivatives can be mono- or dialkylhydroxylamines having one or more hydroxy substituents on the one or more alkyl groups. Representative compounds of this type are described for example in U.S. Pat. No. 5,709,982 (Marrese et al), incorporated herein by reference, as having the structure 1:

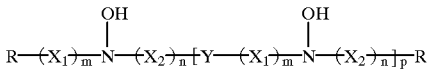

wherein R is hydrogen, a substituted or unsubstituted alkyl group of 1 to 10 carbon atoms, a substituted or unsubstituted hydroxyalkyl group of 1 to 10 carbon atoms, a substituted or unsubstituted cycloalkyl group of 5 to 10 carbon atoms, or a substituted or unsubstituted aryl group having 6 to 10 carbon atoms in the aromatic nucleus.

$X_1$ is —$CR_2(OH)CHR_1$— and $X_2$ is —$CHR_1CR_2(OH)$— wherein $R_0$ and $R_2$ are independently hydrogen, hydroxy, a substituted or unsubstituted alkyl group or 1 or 2 carbon atoms, a substituted or unsubstituted hydroxyalkyl group of 1 or 2 carbon atoms, or $R_1$ and $R_2$ together represent the carbon atoms necessary to complete a substituted or unsubstituted 5- to 8-membered saturated or unsaturated carbocyclic ring structure.

Y is a substituted or unsubstituted alkylene group having at least 4 carbon atoms, and has an even number of carbon atoms, or Y is a substituted or unsubstituted divalent aliphatic group having an even total number of carbon and oxygen atoms in the chain, provided that the aliphatic group has a least 4 atoms in the chain.

Also in Structure I, m, n and p are independently 0 or 1. Preferably, each of m and n is 1, and p is 0.

Specific di-substituted hydroxylamine antioxidants include, but are not limited to: N,N-bis(2,3-dihydroxypropyl)hydroxylamine, N,N-bis(2-methyl-2,3-dihydroxypropyl)hydroxylamine and N,N-bis(I-hydroxymethyl-2-hydroxy-3-phenylpropyl) hydroxylamine. The first compound is preferred.

Many of the noted antioxidants (organic or inorganic) are either commercially available or prepared using starting materials and procedures described in the references noted above in describing hydroxylamines.

Buffering agents are generally present in the color developing compositions of this invention to provide or maintain desired alkaline pH of from about 7 to about 13, and preferably from about 9 to about 13. These buffering agents must be soluble in the organic solvent described herein and have a pKa of from about 9 to about 13. Such useful buffering agents include, but are not limited to carbonates, borates, tetraborates, glycine salts, triethanolamine, diethanolamine, phosphates and hydroxybenzoates. Alkali metal carbonates (such as sodium carbonate, sodium bicarbonate and potassium carbonate) are preferred. Mixtures of buffering agents can be used if desired.

In addition to buffering agents, the pH can also be raised or lowered to a desired value using one or more acids or bases. It may be particularly desirable to raise the pH by adding a base, such as a hydroxide (for example sodium hydroxide or potassium hydroxide).

Another essential component of the color developing concentrates of this invention is a photographically inactive, water-miscible or water-soluble, straight-chain organic solvent that is capable of dissolving color developing agents in their free base forms. Such organic solvents can be used singly or in combination, and preferably each has a molecular weight of at least 50, and preferably at least 100, and generally 200 or less and preferably 150 or less. Such preferred solvents generally have from 2 to 10 carbon atoms (preferably from 2 to 6 carbon atoms, and more preferably from 4 to 6 carbon atoms), and can additionally contain at least two nitrogen or oxygen atoms, or at least one of each heteroatom. The organic solvents are substituted with at least one hydroxy functional group, and preferably at least two of such groups. They are straight-chain molecules, not cyclic molecules.

By "photographically inactive" is meant that the organic solvents provide no substantial positive or negative effect upon the color developing function of the concentrate.

Useful organic solvents include, but are not limited to, polyols including glycols (such as ethylene glycol, diethylene glycol and triethylene glycol), polyhydroxyamines (including polyalcoholamines), and alcohols (such as ethanol and benzyl alcohol). Glycols are preferred with ethylene glycol, diethylene glycol and triethylene glycol being most preferred. Of the alcohols, ethanol and benzyl alcohol are more preferred. The most preferred organic solvent is diethylene glycol.

Still another essential component of the color developing concentrate of this invention is a polyaminopolyphosphonic acid (or salt thereof) that has at least five phosphonic acid (or salt) groups (herein "First Sequestering Agent"). A mixture of such compounds can be used if desired. Suitable salts include ammonium and alkali metal (for example, sodium and potassium) ion salts.

Preferred compounds of this nature can be represented by the following Structure II:

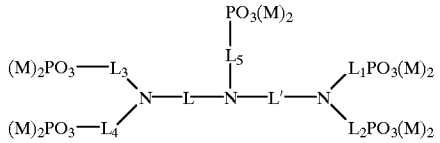

wherein L, L', $L_1$, $L_2$, $L_3$, $L_4$ and $L_5$ are independently substituted or unsubstituted divalent aliphatic linking groups, each independently having 1 to 4 carbon, oxygen, sulfur or nitrogen atoms in the linking group chain. Preferably, these substituted or unsubstituted divalent linking groups have 1 to 4 carbon atoms in the linking group chain (such as substituted or unsubstituted branched or linear alkylene groups). More preferably, the divalent linking groups are independently substituted or unsubstituted methylene or ethylene. Most preferably, L and L' are each substituted or unsubstituted ethylene (preferably unsubstituted), and each of the other linking groups is an unsubstituted methylene group. M is hydrogen or a monovalent cation (such as ammonium ion or an alkali metal salt).

The noted divalent groups can be substituted with any substituent that does not interfere with the desired performance of the sequestering agent, or with the photochemical properties of the color developing concentrates. Such substituents include, but are not limited to, hydroxy, sulfo, carboxy, halo, lower alkoxy (1 to 3 carbon atoms) or amino.

A particularly useful First Sequestering Agent is diethylenetriaminepentamethylenephosphosphonic acid or an alkali metal salt thereof (available as DEQUEST™ 2066 from Solutia Co.).

Still another essential component of the color developing composition of this invention is diphosphonic acid (or salt thereof), herein referred to as "Second Sequestering Agent".

One useful class of Second Sequestering Agents includes hydroxyalkylidene diphosphonic acids (or salts thereof). Mixtures of such compounds can be used if desired. Useful salts include the ammonium and alkali metal ion salts.

Preferred hydroxyalkylidene diphosphonic acids (or salts thereof) can be represented by the following Structure III:

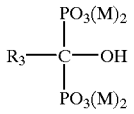

wherein $R_3$ is a substituted or unsubstituted alkyl group having 1 to 5 carbon atoms (methyl, methoxymethyl, ethyl, isopropyl, n-butyl, t-butyl and n-pentyl) and M is hydrogen or a monovalent cation (such as ammonium or alkali metal ions). Preferably, $R_3$ is methyl or ethyl, and most preferably, it is ethyl.

Representative Second Sequestering Agents of this class include, but are not limited to, 1-hydroxyethylidene-1,1-diphosphonic acid, 1-hydroxy-n-propylidene-1,1-diphosphonic acid, 1-hydroxy-2,2-dimethylpropylidene-1,1-diphosphonic acid and others that would be readily apparent to one skilled in the art (and alkali metal and ammonium salts thereof). The first compound is most preferred and is available as DEQUEST™ 2010. Its tetrasodium salt is available as DEQUEST™ 2016D. Both materials are available from Solutia Co.

Another useful Second Sequestering Agent is morpholinomethanediphosphonic acid or a salt thereof.

A mixture of one or more compounds from each class of Second Sequestering Agents can be used in the color developing concentrate of this invention if desired, in any desirable proportions. The total concentration of Second Sequestering Agents is described in TABLE I below.

It is also possible to include other metal ion sequestering agents (for example, for iron, copper or manganese ion sequestration) in the color developing concentrate as long as the other conditions of the invention are met.

The concentrates of this invention can also include one or more of a variety of other addenda that are commonly used in photographic color developing compositions, including alkali metal halides (such as potassium chloride, potassium bromide, sodium bromide and sodium iodide), auxiliary co-developing agents (such as phenidone type compounds particularly for black and white developing compositions), antifoggants, development accelerators, optical brighteners (such as triazinylstilbene compounds), wetting agents, fragrances, stain reducing agents, surfactants, defoaming agents, and water-soluble or water-dispersible color dye forming couplers, as would be readily understood by one skilled in the art [see for example, *Research Disclosure* publications noted above]. The amounts of such additives would be well known to a skilled artisan in view of their usual concentrations in working strength compositions. Representative color developing concentrates of this invention are described below in the examples.

It is preferred that no lithium or magnesium ions are purposely added to the color developing concentrates of this invention at any time. The total concentration (that is, the sum) of these ions remains preferably very low, that is less than 0.00001 mol/l in the concentrates (preferably less than 0.000001 mol/l).

The following TABLE I lists the general and preferred amounts of essential and some optional components of the color developing concentrates of this invention. The preferred ranges are listed in parentheses ( ), and all of the ranges are considered to be approximate or "about" at the upper and lower end points. The amounts are total concentrations for the various components that can be present in mixtures.

TABLE I

| COMPONENT | CONCENTRATIONS |
|---|---|
| Color developing agent(s) | 0.01–1 mol/l (0.04–0.3 mol/l) |
| Antioxidant(s) | 0.005–1 mol/l (0.05–1 mol/l) |
| Buffering agent(s) | 0.5–3 mol/l (1–2 mol/l) |
| First Sequestering Agent(s) | 0.005–0.3 mol/l (0.01–0.1 mol/l) |
| Second Sequestering Agent(s) | 0.0001–0.3 mol/l (0.001–0.05 mol/l) |
| Water to organic solvent(s) (weight ratio) | 25:75–50:50 (30:70–40:60) |

In preferred embodiments of this invention, a homogeneous, ready to use, single-part color developing concentrate is essentially free of sulfate, magnesium and lithium ions and has a pH of from about 9 to about 13 and comprises:

a) from about 0.04 to about 0.3 mol/l of CD-3 color developing agent in free base form, b) from about 0.05 to about 1 mol/l of N,N-diethylhydroxylamine or N,N'-bis(2-methyl-2,3-dihydroxypropyl)hydroxylamine as an antioxidant for the color developing agent, c) water, d) ethylene glycol or diethylene glycol present at a concentration such that the weight ratio of water to the solvent is from about 15:85 to about 50:50, e) from about 0.01 to about 0.1 mol/l of diethylenetriaminepentamethylenephosphonic acid (or a salt thereof), f) from about 0.0001 to about 0.05 mol/l of either:

1-hydroxyethylidene-1,1-diphosphonic acid (or a salt thereof), or morpholinomethanediphosphonic acid (or a salt thereof), and g) one or more carbonate buffering agents.

The color developing concentrates of this invention have utility to provide color development in an imagewise exposed color photographic silver halide element comprising a support and one or more silver halide emulsion layers containing an imagewise distribution of developable silver halide emulsion grains. A wide variety of types of photographic elements (both color negative and color reversal films and papers, and color motion picture films and prints) containing various types of emulsions can be processed using the present invention, the types of elements being well known in the art (see Research Disclosure publication 38957 noted above). In particular, the invention can be used to process color photographic papers of all types of emulsions including so-called "high chloride" and "low chloride" type emulsions, and so-called tabular grain emulsions as well. The color developing concentrate can also be used in processing of color reversal and color negative films.

The present invention is particularly useful to process high chloride (greater than 70 mole % chloride and preferably greater than 90 mole % chloride, based on total silver) emulsions in color photographic papers. Such color photographic papers can have any useful amount of silver coated in the one or more emulsions layers, and in some embodiments, low silver (that is, less than about 0.8 g silver/$m^2$) elements are processed with the present invention. The layers of the photographic elements can have any useful binder material or vehicle as it known in the art, including various gelatins and other colloidal materials.

Representative commercial color papers that are useful in the practice of this invention include, but are not limited to, KODAK EKTACOLOR EDGE V, VII and VIII Color Papers (Eastman Kodak Company), KODAK ROYAL VII Color Papers (Eastman Kodak Company), KODAK PORTRA III, IIIM Color Papers (Eastman Kodak Company), KODAK SUPRA III and IIIM Color Papers (Eastman Kodak Company), KODAK ULTRA III Color Papers (Eastman Kodak Company), FUJI SUPER Color Papers (Fuji Photo Co., FA5, FA7 and FA9), FUJI CRYSTAL ARCHIVE and Type C Color Papers (Fuji Photo Co.), KONICA COLOR QA Color Papers (Konica, Type QA6E and QA7), and AGFA TYPE II and PRESTIGE Color Papers (AGFA). The compositions and constructions of such commercial color photographic elements would be readily determined by one skilled in the art. KODAK DURATRANS, KODAK DURACLEAR, KODAK EKTAMAX RAL and KODAK DURAFLEX photographic materials, and KODAK Digital Paper Type 2976 can also be processed using the present invention.

Color development of an imagewise exposed photographic silver halide element is carried out by contacting the element with a color developing composition prepared according to this invention under suitable time and temperature conditions, in suitable processing equipment, to produce the desired developed image. Additional processing steps can then be carried out using conventional procedures, including but not limited to, one or more development stop, bleaching, fixing, bleach/fixing, washing (or rinsing), stabilizing and drying steps, in any particular desired order as would be known in the art. Useful processing steps, conditions and materials useful therefor are well known for the various processing protocols including the conventional Process C-41 processing of color negative films, Process RA-4 for processing color papers and Process E-6 for processing color reversal films (see for example, *Research Disclosure* publication 38957 noted above).

The photographic elements processed in the practice of this invention can be single or multilayer color elements. Multilayer color elements typically contain dye image-forming units sensitive to each of the three primary regions of the visible spectrum. Each unit can be comprised of a single emulsion layer or multiple emulsion layers sensitive to a given region of the spectrum. The layers of the element can be arranged in any of the various orders known in the art. In an alternative format, the emulsions sensitive to each of the three primary regions of the spectrum can be disposed as a single segmented layer. The elements can also contain other conventional layers such as filter layers, interlayers, subbing layers, overcoats and other layers readily apparent to one skilled in the art. A magnetic backing can be included on the backside of conventional supports.

More details of the element structure and components, and suitable methods of processing various types of elements are described in *Research Disclosure* publication 38957 (noted above). Included within such teachings in the art is the use of various classes of cyan, yellow and magenta color couplers that can be used with the present invention (including pyrazolone and pyrazolotriazole type magenta dye forming couplers). In addition, the present invention can be used to process color photographic papers having pigmented resin-coated paper supports which are prepared with the usual internal and external sizing agents (including alkylketene dimers and higher fatty acids), strengthening agents and other known paper additives and coatings.

The color developing concentrate of this invention can also be used in what are known as redox amplification processes, as described for example, in U.S. Pat. No. 5,723,268 (Fyson) and U.S. Pat. No. 5,702,873 (Twist).

Processing according to the present invention can be carried out using conventional deep tanks holding processing solutions. Alternatively, it can be carried out using what is known in the art as "low volume thin tank" processing systems, or LVTT, which have either a rack and tank or automatic tray design. These processors are sometimes known as "minilabs." Such processing methods and equipment are described, for example, in U.S. Pat. No. 5,436,118 (Carli et al) and publications noted therein.

Color development is generally followed by desilvering using separate bleaching and fixing steps, or a combined bleach/fixing step using suitable silver bleaching and fixing agents. Numerous bleaching agents are known in the art, including hydrogen peroxide and other peracid compounds, persulfates, periodates and ferric ion salts or complexes with polycarboxylic acid chelating ligands. Particularly useful chelating ligands include conventional polyaminopolycarboxylic acids including ethylenediaminetetraacetic acid and others described in Research Disclosure publication 38957 noted above, U.S. Pat. No. 5,582,958 (Buchanan et al) and U.S. Pat. No. 5,753,423 (Buongiorne et al). Biodegradable chelating ligands are also desirable because the impact on the environment is reduced. Useful biodegradable chelating ligands include, but are not limited to, iminodiacetic acid or an alkyliminodiacetic acid (such as methyliminodiacetic acid), ethylenediaminedisuccinic acid and similar compounds as described in EP-A-0 532,003, and ethylenediamine monosuccinic acid and similar compounds as described in U.S. Pat. No. 5,691,120 (Wilson et al). Useful fixing agents are also well known in the art and include various thiosulfates and thiocyanates or mixtures thereof.

The processing time and temperature used for each processing step of the present invention are generally those conventionally used in the art. For example, color development is generally carried out at a temperature of from about 20 to about 60° C. The overall color development time can be up to 40 minutes, and preferably from about 75 to about 450 seconds. The shorter overall color development times are desired for processing color photographic papers.

The color developing concentrate of this invention can be formulated into a working strength solution or replenisher by suitable dilution of up to 12 times. Generally, the dilution rate is from about 4 to about 10 times, using water as a common diluent. Dilution can occur during or prior to its use if photographic processing.

In one embodiment of this invention, the color developing concentrate of this invention is one chemical formulation in a photographic processing chemical kit that can include one or more other photographic processing compositions (dry or liquid) including, but not limited to, a photographic bleaching composition, a photographic bleach/fixing composition, a photographic fixing composition, and a photographic dye stabilizing or rinsing composition. Such additional compositions can be formulated in concentrated or working strength solutions, or provided in dry form (for example, as a powder or tablet). Other processing compositions that can be included in such kits for either black and white or color photographic processing are reversal compositions, conditioning compositions, prebleach compositions, acidic stop compositions, and others readily apparent to one skilled in the photographic art. The processing kits can also include various processing equipment, metering devices, processing instructions, silver recovery devices and other conventional materials as would be readily apparent to one skilled in the art.

The following examples are provided to illustrate the practice of this invention and not to limit it in any way. Unless otherwise indicated, percentages are by weight.

EXAMPLE 1

Color Paper Color Developing Concentrate

A most preferred color developing concentrate of this invention (1 liter) was formulated in the following preferred manner:

A "first" solution was prepared by adding sodium hydroxide (50% solution, 30.7 g) to a solution of 4-(N-ethyl-N-2-methanesulfonylaminoethyl)-2-methylphenylenediamine sesquisulfate (CD-3, 52.3 g) and N,N-diethylhydroxylamine antioxidant (41.5 g) in water (46.1 g). Because the antioxidant is an organic liquid, two phases resulted. With stirring, diethylene glycol (385 g) was then added and a precipitate of sodium sulfate was observed. This precipitate was filtered out of the solution, washed with 96 g of diethylene glycol that was then added to the solution, and the precipitate was discarded.

The diphosphonic acid, 1-hydroxyethylidene-1,1-diphosphonic acid (0.55 g, 60%, DEQUEST™ 2010 from Solutia Co.) was added to water (49.8 g). This solution was added to a solution of potassium carbonate (353.3 g, 47.5%) and potassium bicarbonate (14.6 g) buffering agents, and diethylenetriaminepentamethylenephosphonic acid (40 g, 25 %, DEQUEST™ 2066 from Solutia Co.) to form a "second" solution. The additional components listed in TABLE II were all added to the second solution.

TABLE II

| | |
|---|---|
| Triethanolamine (85% solution) | 23 g |
| Substituted triazinylstilbene optical brightener (BLANKOPHOR REU 180 from Bayer) | 8.5 g |
| Potassium bromide | 0.19 g |
| Diethylene glycol | 129 g |

After the addition of these components, the second solution was added to the first solution, with stirring, until a homogeneous solution was obtained. The resulting concentrate was then filtered to remove any haze and packaged as a homogeneous, ready to use, single-part color developing concentrate. This concentrate was essentially free of all sulfate, magnesium and lithium ions.

EXAMPLE 2

Alternative Color Paper Color Developing Concentrate

A homogeneous, ready to use, single-part concentrate was prepared like that described in Example 1 except N,N-diethylhydroxylamine was replaced with N,N'-bis(2,3-dihydroxypropyl)hydroxylamine (35.4 g of 45.7% solution). The resulting concentrate (about 1 liter) was homogeneous and free of haze and sulfate, magnesium and lithium ions.

EXAMPLE 3

Preparation of Working Strength Color Developing Composition and Processing of Color Paper A color developing composition useful for photoprocessing was prepared by diluting the concentrate described in Example 1 about 7.7 times with water.

This composition was then used for color development in processing imagewise exposed samples of commercially available KODAK EKTACOLOR EDGE V Color Paper using the following processing protocol and conditions to obtain acceptable color images:

| | | |
|---|---|---|
| Color Development | 38° C. | 45 seconds |
| Bleach/fixing | 35° C. | 45 seconds |
| Washing (water) | 35° C. | 90 seconds |

Bleach/fixing was carried out using commercially available EKTACOLOR RA Bleach Fix NR.

Comparative Experiments:

Several attempts to make a homogeneous, ready to use, single-part concentrate using procedures outside of the scope of the present invention.

In another experiment, a solution like the second solution described in Example 1 was prepared except that the 1-hydroxyethylidene-1,1-diphosphonic acid was omitted at the beginning of the formulation, and was added at the very end after all other components had been mixed. This caused extensive, unsafe effervescence (that is, outgassing) in the combined solutions. We did not mix the first and second solutions because this procedure could not be used in an economical and safe fashion in manufacturing environments. Moreover, even if they could be mixed, the resulting concentrate could have a pH that was too low for practical use.

Still another experiment was carried out to prepare a second solution except that we attempted to add the 1-hydroxyethylidene-1,1-diphosphonic acid to triethanolamine instead of water. Oil droplets resulted forming two phases. No further mixing was attempted.

Another failed experiment was evident when we attempted to add 1-hydroxyethylidene-1,1-diphosphonic acid (undiluted) to the carbonate buffering agents. Significant effervescence was observed in this instance also.

Moreover, we prepared first and second solutions as described in Example 1 (but without the 1-hydroxyethylidene-1,1-diphosphonic acid), mixed them together, and then added the diphosphonic acid. Significant effervescence was observed.

EXAMPLE 4

Alternative Method of Preparing a Concentrate Using Free Acid

An alternative method of making the concentrate of this invention was carried out by adding 1-hydroxyethylidene- 1,1-diphosphonic acid (0.55 g, 60%) as the last component to the first solution (instead of putting it into the second solution). A second solution was then prepared and mixed with the first solution to provide a useful concentrate.

EXAMPLE 5

Use of Diphosphonic Acid Salt

A useful concentrate was also prepared by mixing the first and second solutions (but without a diphosphonic acid), and then adding 1-hydroxyethylidene-1,1-diphosphonic acid, tetrasodium salt (0.37 g).

EXAMPLE 6

Alternative Method of Using Diphosphonic Acid Salt

A useful concentrate was prepared as described in Example 4 except that 1-hydroxyethylidene-1,1-diphosphonic acid, tetrasodium salt (0.37 g) was used in place of the free acid.

EXAMPLE 7

Additional Method of Using Diphosphonic Acid Salt

Still another useful concentrate was prepared by adding 1-hydroxyethylidene-1,1-diphosphonic acid, tetrasodium salt (0.37 g) at the end of formulation of the second solution. The first and second solutions were then mixed.

The invention has been described in detail with particular reference to preferred embodiments thereof, but it will be understood that variations and modifications can be effected within the spirit and scope of the invention.

We claim:

1. A homogeneous, ready to use, single-part color developing concentrate having a pH of from about 7 to about 13 and comprising:

a) at least 0.04 mol/l of a color developing agent in free base form, b) at least 0.005 mol/l of an antioxidant for said color developing agent, c) water, d) a photographically inactive water-miscible or water-soluble hydroxy-containing, straight-chain organic solvent for said color developing agent in free base form, said organic solvent having a molecular weight of from about 50 to about 200 and being present in said concentrate at a concentration such that the weight ratio of water to said solvent is from about 15:85 to about 50:50, e) at least 0.005 mol/l of a polyaminopolyphosphonic acid that has at least five phosphonic acid groups, or a salt thereof, f) at least 0.0001 mol/l of a diphosphonic acid that is either:

hydroxyalkylidene diphosphonic acid or a salt thereof, or morpholinomethanediphosphonic acid or a salt thereof, and g) at least 0.5 mol/l of a buffering agent that is soluble in said organic solvent.

2. The color developing concentrate of claim 1 having a pH of from about 9 to about 13.

3. The color developing concentrate of claim 1 wherein said color developing agent is present in an amount of from about 0.04 to about 0.3 mol/l, said antioxidant is present in an amount of from about 0.05 to about 1 mol/l, and the weight ratio of water to said organic solvent if from about 30:70 to about 40:60.

4. The color developing concentrate of claim 1 wherein said antioxidant is a hydroxylamine derivative having a solubilizing group.

5. The color developing concentrate of claim 4 wherein said antioxidant is represented by the structure I:

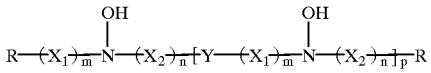

wherein R is hydrogen, an alkyl group, a hydroxyalkyl group, a cycloalkyl group or an aryl group, $R_1$ and $R_2$ are independently hydrogen, hydroxy, an alkyl group, or a hydroxyalkyl group, or $R_1$ and $R_2$ together represent the carbon atoms necessary to complete a 5- to 8-membered carbocyclic ring structure, $X_1$ is —$CR_2(OH)CHR_1$—, $X_2$ is —$CHR_1CR_2(OH)$—, and m, n and p are independently 0 or 1.

6. The color developing concentrate of claim 1 wherein said organic solvent that has a molecular weight of from about 100 to about 200 and has from 2 to 10 carbon atoms.

7. The color developing concentrate of claim 6 wherein said organic solvent is an alcohol or a glycol.

8. The color developing concentrate of claim 7 wherein said organic solvent is ethylene glycol, diethylene glycol, triethylene glycol, ethanol or benzyl alcohol.

9. The color developing concentrate of claim 1 wherein said buffering agent is a carbonate.

10. The color developing concentrate of claim 1 wherein said polyaminopolyphosphonic acid or salt thereof is present in an amount of from about 0.005 to about 0.3 mol/l, and said diphosphonic acid or salt thereof is present in an amount of from about 0.001 to about 0.3 mol/l.

11. The color developing concentrate of claim 1 wherein said polyaminopolyphosphonic acid or a salt thereof is represented by the Structure II:

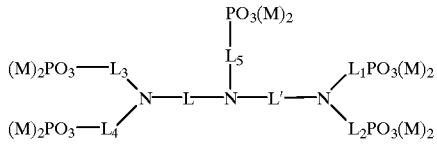

wherein L, L', $L_1$, $L_2$, $L_3$, $L_4$ and $L_5$ are independently divalent aliphatic linking groups independently having from 1 to 4 carbon, oxygen, sulfur or nitrogen atoms in the linking group chain, and M is hydrogen or a monovalent cation.

12. The color developing concentrate of claim 11 wherein said divalent aliphatic linking groups independently have from 1 to 4 carbon atoms in the linking group chain.

13. The color developing concentrate of claim 12 wherein said polyaminopolyphosphonic acid or salt thereof is diethylenetriaminepentamethylenephosphonic acid or a salt thereof.

14. The color developing concentrate of claim 1 wherein said diphosphonic acid or salt thereof is a hydroxyalkylidene diphosphonic acid or a salt thereof is represented by Structure III:

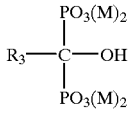

wherein $R_3$ is an alkyl group of 1 to 5 carbon atoms, and M is hydrogen or a monovalent cation.

15. The color developing concentrate of claim 14 wherein $R_3$ is methyl or ethyl and M is hydrogen or an alkali metal ion.

16. The color developing concentrate of claim 1 wherein said diphosphonic acid or salt thereof is morpholinomethanediphosphonic acid or a salt thereof.

17. The color developing concentrate of claim 1 comprising no purposely added lithium or magnesium ions.

18. A photographic processing chemical kit comprising:

a) the single-part color developing concentrate of claim 1, and b) one or more of the following compositions:
a photographic bleaching composition,
a photographic bleach/fixing composition,
a photographic fixing composition, and
a photographic stabilizing or final rinsing composition.

19. A method for providing a color image in a photographic silver halide element comprising contacting the element with, upon dilution of at least four times, the single-part color developing concentrate of claim 1.

20. A method of photographic processing comprising the steps of:

A) color developing an imagewise exposed photographic color silver halide element with, upon dilution of at least four times, the color developing concentrate of claim 1, and B) desilvering said color developed photographic color silver halide element.

21. The method of claim 20 wherein said color photographic silver halide element is a color negative silver halide film.

22. The method of claim 20 wherein said color photographic silver halide element is a color photographic paper.

23. The method of claim 20 carried out in a minilab.

24. A homogeneous, ready to use, single-part color developing concentrate that is essentially free of sulfate, magnesium and lithium ions and has a pH of from about 9 to about 13 and comprises:

a) from about 0.04 to about 0.3 mol/l of CD-3 color developing agent in free base form, b) from about 0.05 to about 1 mol/l of N,N-diethylhydroxylamine or N,N'-bis(2-methyl-2,3-dihydroxypropyl)hydroxylamine as an antioxidant for said color developing agent, c) water, d) ethylene glycol or diethylene glycol present in said concentrate at a concentration such that the weight ratio of water to said solvent is from about 30:70 to about 40:60, e) from about 0.01 to about 0.1 mol/l of diethylenetriaminepentamethylenephosphonic acid, or a salt thereof, f) from about 0.001 to about 0.05 mol/l of either:
1-hydroxyethylidene-1,1-diphosphonic acid or a salt thereof, or morpholinomethanediphosphonic acid or a salt thereof, and g) one or more carbonate buffering agents.

* * * * *